US006073294A

United States Patent [19]

Mashtare et al.

[11] Patent Number: 6,073,294

[45] Date of Patent: Jun. 13, 2000

[54] CLEANING BRUSH USING THE PYROELECTRIC EFFECT

[75] Inventors: Dale R. Mashtare, Palmyra; Christopher Snelling, East Rochester, both of N.Y.

[73] Assignee: Xerox Corporation, Stamford, Conn.

[21] Appl. No.: 09/218,672

[22] Filed: Dec. 22, 1998

[51] Int. Cl.[7] ..... G03G 21/00

[52] U.S. Cl. ..... 15/1.51; 15/256.5; 15/179; 15/181; 399/353; 399/354

[58] Field of Search ..... 15/77, 102, 256.5, 15/179, 181, 1.51; 399/353, 354

[56] References Cited

U.S. PATENT DOCUMENTS

| | | |
|---|---|---|
| 3,722,018 | 3/1973 | Fisher . |
| 4,835,807 | 6/1989 | Swift . |
| 5,153,615 | 10/1992 | Snelling . |
| 5,450,186 | 9/1995 | Lundy . |
| 5,593,151 | 1/1997 | Mashtare et al. . |
| 5,619,314 | 4/1997 | Kubo . |
| 5,678,145 | 10/1997 | Snelling et al. . |
| 5,689,791 | 11/1997 | Swift . |
| 5,710,966 | 1/1998 | Otsuka et al. . |
| 5,914,741 | 6/1999 | Snelling et al. . |
| 5,929,886 | 7/1999 | Snelling et al. . |
| 6,009,301 | 12/1999 | Maher et al. . |

*Primary Examiner*—Terrence R. Till
*Assistant Examiner*—Jennifer C. McNeil

[57] ABSTRACT

Apparatus for removing residual charged toner particles from a charge retentive surface characterized by a self-biasing pyroelectric cleaner brush and a detoning member for removing the charged particles from the self-biasing pyroelectric cleaner brush. The brush includes a pyroelectric polymer supported by a conductive roll with resistive fibers attached to one surface of the pyroelectric polymer. Heating and cooling of a pyroelectric polymer induces thermal expansion or contraction which create surface charge density charges that are used to supply charge to the resistive fibers. The oppositely charged resistive fibers contact the toner particles on the charge retentive surface to thereby remove them from the charge retentive surface.

17 Claims, 3 Drawing Sheets

CLEANING BRUSH USING THE PYROELECTRIC EFFECT

BACKGROUND OF THE INVENTION

Cross-reference is hereby made to commonly assigned and copending U.S. application Ser. No. 09/218244 (D/98650), entitled Active Electrostatic Cleaning Brush by Christopher Snelling and U.S. application Ser. No. 09/219725 (D/98651), entitled Xeromorph Electrostatic Cleaning Brush by Dale Mashtare and Christopher Snelling.

This invention relates to a printing apparatus, and more particularly, to a cleaning apparatus for removing residual particles such as toner and debris from a charge retentive surface forming a part of the printing apparatus.

In printing arts of the type contemplated, one method of forming images is using a charge retentive surface such as a photoreceptor or photoconductor. It comprises a photoconductive insulating material adhered to a conductive backing which is charged uniformly. Then the photoreceptor is exposed to a light image of an original document to be reproduced. The latent electrostatic images, thus formed, are rendered visible by applying any one of numerous pigmented resins specifically designed for this purpose. In this case of a reusable photoreceptor, the pigmented resin, more commonly referred to as toner which forms the visible images is transferred to plain paper. After transfer, the toner images are made to adhere to the copy medium usually through the application of heat and pressure by means of a roll fuser.

Although a preponderance of the toner forming the images is transferred to the paper during transfer, some toner remains on the photoreceptor surface, it being held thereto by relatively high electrostatic and/or mechanical forces. It is essential for optimum operation that the toner and debris remaining on the surface be cleaned thoroughly therefrom.

A commercially successful mode of cleaning employed in automatic xerography utilizes a brush with soft bristles which have suitable triboelectric characteristics. While the bristles are soft they are sufficiently firm to remove residual toner particles from the xerographic plate. In addition, webs or belts of soft fibrous or tacky materials and other cleaning systems are known.

More recent developments in the area of removing residual toner and debris from a charge retentive surface have resulted in cleaning structures which, in addition to relying on the physical contacting of the surface to be acted upon, also rely on electrostatic fields established by electrically biasing one or more members of the cleaner system.

It has been found that establishing an electrostatic field between the charge retentive surface and the cleaning member such as a fiber brush or a magnetic brush enhances toner attraction to the cleaning brush surface. Such arrangements are disclosed in U.S. Pat. Nos. 3,572,923, and 3,722,018 granted to Fisher et al. on Mar. 22, 1973 and Fisher on Mar. 30, 1971, respectively. Likewise, when an electrostatic field is established between the brush and a brush detoning member, removal of toner from the brush is improved. The creation of the electrostatic field between the brush and photoreceptor is accomplished by applying a D.C. voltage to the brush. When the fibers or granules forming the brush are electrically conductive and a bias is applied thereto cleaning is observed to be more efficient than if the fibers or granules are non-conductive or insulative.

PRIOR ART

Heretofore, polyvinylidene fluoride (PVDF) film and other materials have been known to exhibit pyroelectric effects. For example, it is known that the PVDF films may be heated to induce the formation of an electrostatic charge on the surface of the film. In addition, polarization of the film, where the majority of the dipole moments are permanently aligned increases the magnitude of the pyroelectric behavior for the film. Alternatively, other materials, such as, triglycine sulfate (TGS) may be used to produce the electrostatic charge in response to a change in temperature, as described by Crowley in "Fundamentals of Applied Electrostatics" (Wiley & Sons, New York, 1986, pp. 137–145).

For example, U.S. Pat. No. 5,185,619 discloses a printer that includes the use of pyroelectric imaging members to produce prints. And Bergman et al. in U.S. Pat. No. 3,824,098 teaches an electrostatic copying device having a polymeric polyvinylidene fluoride film as a medium for producing a patterned electrostatic charge.

In U.S. Pat. No. 5,678,145 a method and apparatus is disclosed that enables charging and transfer steps in xerographic systems by using pyroelectric materials to create net charge/surface potentials. Heating and cooling a pyroelectric film, such as PVDF, induces thermal expansion or contraction which creates surface charge density changes which are used to provide required charging of the photoconductive member before exposure of the photoconductive member in imagewise configuration takes place, as well as, provide electrical charge as required for transfer of an image from the photoconductive member to a copy sheet.

SUMMARY OF THE INVENTION

In accordance with the improved features of the present invention, there is provided a self-biasing cleaning brush that uses the pyroelectric effect to remove toner particles from a surface with subsequent separation of the particles from the brush with a detoning roll. The self-biasing brush is made by incorporating flexible, resistive fiber material onto the surface of a layer of polyvinyldiene flouride (PVDF) in a roll configuration. The brush fibers are adhered to the surface of the PVDF material that is layered onto a conductive roll. Fiber potentials may be realized by heating the roll structure to thereby produce the pyroelectric effect in the PVDF material and thus, providing biases for both cleaning, as well, detoning. In practice, the brush fibers are used to contact a photoreceptor surface and detone rolls while piezopolymer layers of the cleaning roll are used to provide the necessary voltage.

DESCRIPTION OF THE PREFERRED EMBODIMENTS

Other aspects of the present invention will become apparent as the following description proceeds with reference to the drawings in which.

As indicated hereinabove, the present invention provides a novel active electrostatic cleaning brush for use in an electrostatographic printing machine. While the present invention will be described with reference to a preferred embodiment thereof, it will be understood that the invention is not limited to this preferred embodiment. On the contrary, it is intended that the present invention cover all alternatives, modifications, and equivalents as may be indicated within the spirit and scope of the invention as defined by the appended claims. Other aspects and features of the present invention will become apparent as the description proceeds.

Figure 2:
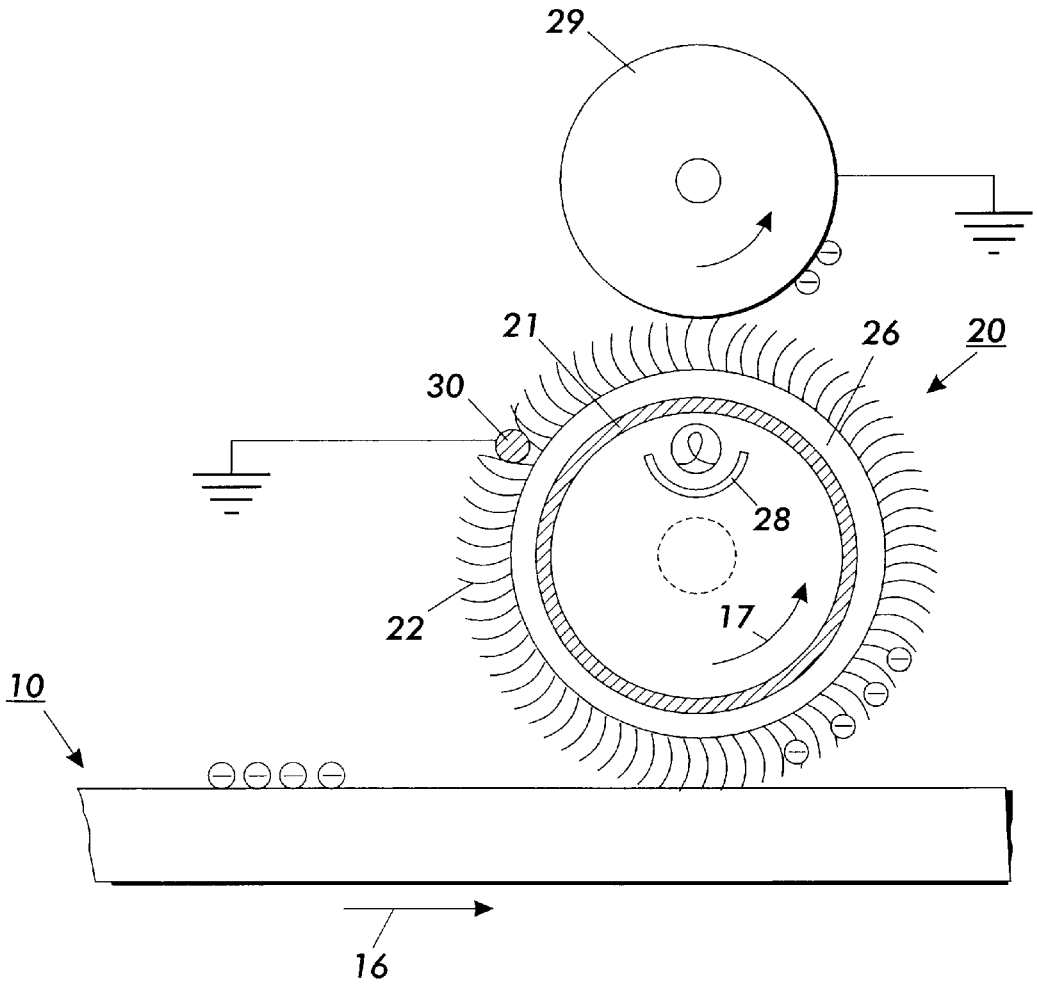
FIG. 2 is a schematic elevational view depicting a partial electrophotographic printing machine incorporating the pyroelectric cleaning brush of the present invention.

Referring now to FIG. 2, cleaning brush 20 that utilizes the pyroelectric effect in accordance with the present invention is shown in a roll configuration 20 and comprises a top layer of a piezoelectric film, such as, poled polyvinylidene fluoride (PVDF) film 26. Preferably, Kynar® piezo film manufactured by Measurement Specialties Incorporated. A sheet of PVDF film is mounted on a conductive roll core 21 that is grounded. The film is polarized in a direction orthogonal to the surface of the conductive roll. An insulative adhesive is adhered to the top surface of PVDF film 26 and is used to attach resistive fibers 22 to the top surface of the PVDF film. The brush fibers may be carbon fibers that are presently used for electrostatic brush cleaners, if desired. Other adhesive materials and techniques could be applied to bond fibers 22 in close proximity to the PVDF layer as long as the adhesive layer provides z-axis conductivity, for example 3M Scotch 9703 Conductive Adhesive Transfer Tape, or a patterned conductive adhesive such that conductive strips are formed on the surface of the PVDF film.

Figure 1:
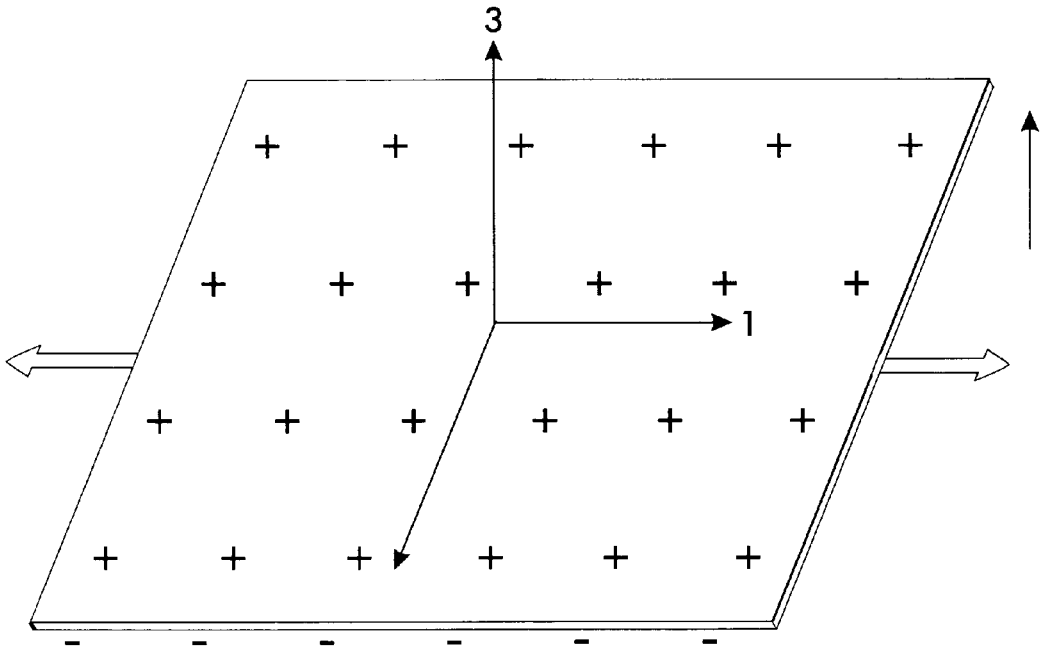
FIG. 1 PRIOR ART
FIG. 1 is a perspective view illustrating the geometry of a prior art piezoelectric sheet.

Piezoelectric materials are formed by stretching PVDF film in one direction, applying a large electric field to electrically polarize it in a direction perpendicular to the film. As shown in FIG. 1, the stretch direction is denoted by "1" and the polarization direction is noted by "3". When a PVDF sheet is strained, it develops an internal electric field, which is proportioned to the deformation.

The self-biasing cleaning brush 20 of the present invention in FIG. 2 is based upon the pyroelectric effect of the poled PVDF film to enable the performance of the xerographic cleaning process step without the need for a high voltage power supply. This desirable result and advantage is obtained through generation of functional net charge/surface potentials in the cleaning brush 20 from thermal energy input to poled PVDF material, due to its pyroelectric effect properties.

As can be seen from FIG. 2, the self-biasing electrostatographic cleaning brush 20 is in operative engagement with a grounded photoconductive belt 10 which can consist of an electrically conductive substrate, a charge generator layer comprising photoconductive particles randomly dispersed in an electrically insulating organic resin and a charge support layer comprising a transport electrically inactive polycarbonate resin having dispersed therein one or more diamides. Photocoductive belt 10 moves in the direction of arrow 16 to advance successive portions thereof sequentially throughout the various processing stations disposed about the path of movement thereof.

Self-biasing electrostatic cleaning brush 20 comprises a roll 21 with a pyroelectric polymer film covering 26 adapted to be driven in the direction of arrow 17 with a plurality of resistive fibers 22 attached thereto. A negative potential is generated in film 26 by the use of infrared heat lamp 28 positioned in a predetermined location within roll 21 that is adapted to heat the poled PVDF material to achieve the electric fields/surface potentials required for cleaning photoreceptor 10 by direct conversion of thermal energy through the pyroelectric effect in appropriately poled PVDF materials, for example. Resistive fibers 22 are negatively charged by being in contact with film 26 and this negative energization is used to enhance detoning of negative charged toner from the resistive fibers 22. A grounded detoning roll 29 is used to remove toner particles from fibers 22.

As roll 21 rotates, heat lamp 28 raises the temperature of film 26 and thereby creates a negative polarity in the film due to the pyroelectric effect. The film cools to a second temperature between the location of heat lamp 28 and conductive contact 30 where conductive contact 30 neutralizes resistive fibers 22 and film 26. Film 26 cools further achieving a positive potential as resistive fibers 22 are brought into contact with the photoreceptor 10 and this positive cleaning bias that has been generated in the fibers is used to attract the negatively charged residual toner remaining on the outer surface of photoreceptor 10. The captured toner particles are again subsequently repelled toward a grounded conductive detoning roll 29.

Figure 3:
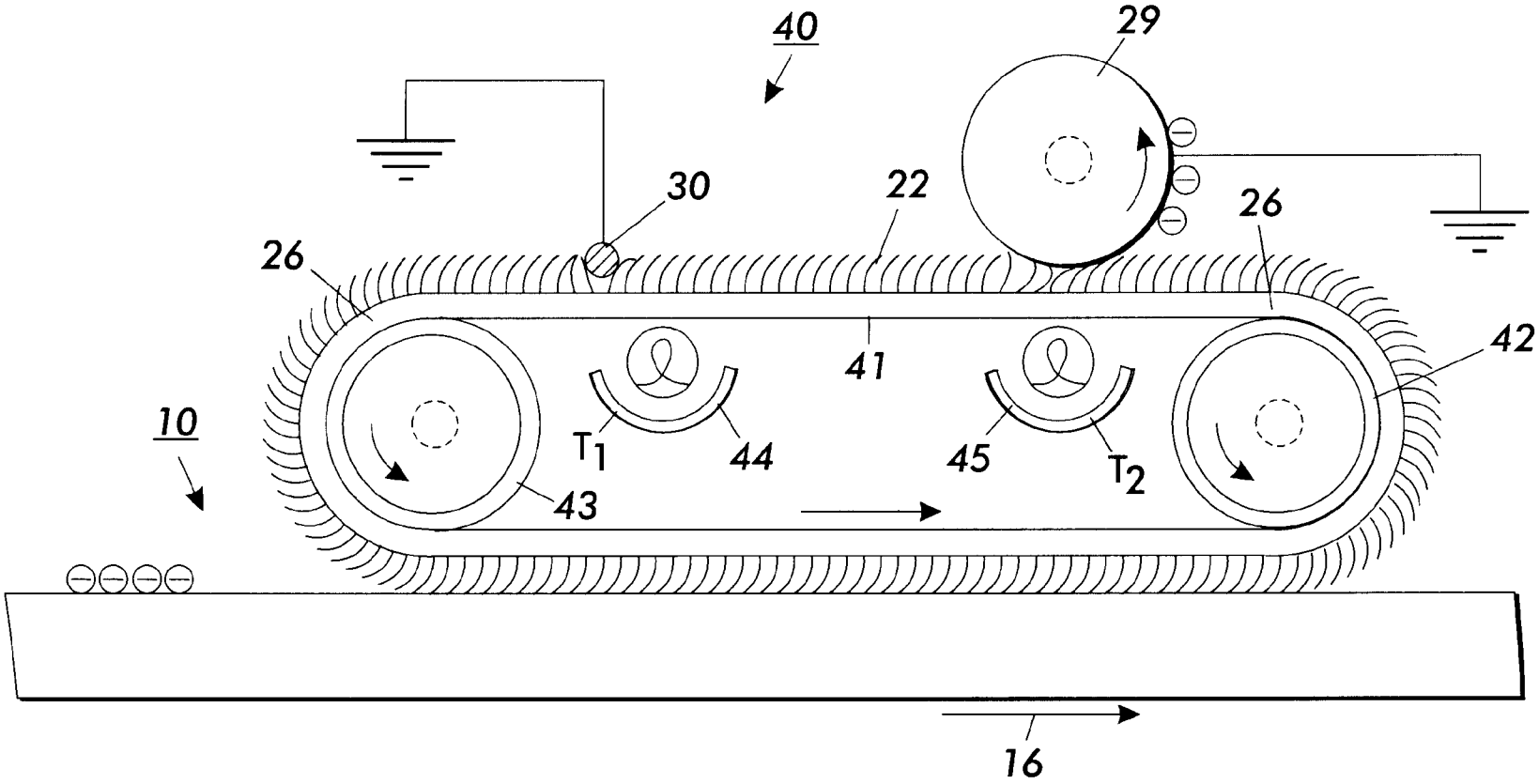
FIG. 3 is a schematic elevational view depicting a partial electrophotographic printing machine incorporating a belt configured pyroelectric cleaning brush in accordance with the present invention.

A belt configuration 40 of the pyroelectric cleaning brush of the present invention that allows more time for heating and cooling of a pyroelectric film is shown in FIG. 3 and comprises a conductive belt 41 mounted on drive roll 42 and an idler roll 43. A pyroelectric film 26 is positioned on top of belt 41 and has resistive fibers 22 attached to the pyroelectric film by an adhesive. Infrared heaters 44 and 45 are used to heat the pyroelectric film to temperatures $T_1$ and $T_2$ to thereby trigger the pyroelectric effect. For example, heater 44 raises the temperature of the pyroelectric film 26 to a temperature of $T_1$ producing a negative polarity bias in the film due to the pyroelectric effect. At this point the film 26 and resistive fibers 22 are neutralized with the conductive contact 30. The film 26 cools thereby achieving a positive potential as the film 26 and resistive fibers 22 rotate into contact with the photoreceptor surface 10. This positive potential on the resistive fibers 22 is used to attract the residual toner from the photoreceptor surface 10. The film cools until it reaches heater 45 where it is heated again to a temperature of $T_2$ to enhance detoning of captured negatively charged toner picked up from the top surface of photoreceptor 10. Grounded detoning roll 29 removes the toner particles away from the resistive fibers 22. In FIG. 3, $T_2$ is greater than $T_1$. If desired, heater $T_1$ could be eliminated in reliance on cooling of the film upon arriving at the position to remove toner from the surface of the photoreceptor.

It is contemplated that an external contact heater could be used to heat film 26, if desired, but this requires thermal conduction through the fibers. Also, different temperatures zone could be applied to roll 21 to enable varied potentials or even polarities. If desired, pyroelectric fibers could be used to remove toner particles from a charge retentive surface.

It should now be appreciated that an improved power supplyless, self-biasing pyroelectric cleaning brush has been disclosed that incorporates resistive fiber material onto the surface of a pyroelectric polymer covered roll. The resistive fibers are adhered to the surface of the roll thorough the use of an insulative layer that provides isolation between zones of the roll to enable the generation of varied potentials about the circumference of the roll. The varied potentials are obtained by heating different areas around the roll to actuate different areas of the pyroelectric polymer material covering the roll and thereby provide biases for both cleaning and detoning of toner particles from a surface of a charge retentive member.

While polyvinylidene fluoride film is disclosed as the preferable film for use with the present invention, materials other than PVDF can be used successfully, for example, composite piezoelectric ceramic and binder polymers, or other piezoelectric polymer materials. Also, external heaters could be used with the present invention, if desired.

The invention has been described with reference to the structure herein disclosed, however, it is not intended to be confined to the details as set forth and is intended to cover any modifications and changes that may come within the scope of the following claims.

What is claimed is:

1. Apparatus that employs the pyroelectric effect to remove charged toner particles from a charge retentive surface, said apparatus comprising:

a conductive roll support structure;

a film of a pyroelectric polymer completely covering said conductive roll;

resistive fibers attached to said film, said resistive fibers being adapted to be placed in contacting relation with the toner particles on the charge retentive surface; and a heater in communication with said film for heating said film to produce surface potentials that bias said resistive fibers.

2. The apparatus of claim 1, including a detoning member, said detoning member being positioned to be contacted by said resistive fibers.

3. The apparatus of claim 2, wherein said detoning member is grounded.

4. The apparatus of claim 3, wherein said heater is an infrared heater.

5. The apparatus of claim 4, wherein said film includes polyvinylidene fluoride.

6. Apparatus for removing charged toner particles from a charge retentive surface, said apparatus comprising:

a conductive roll;

at least one layer of a pyroelectric polymer covering said conductive roll;

flexible, resistive fibers extending from a surface of said pyroelectric polymer; and a heater in communication with said pyroelectric polymer for heating said pyroelectric polymer to produce surface potentials that bias said resistive fibers.

7. The apparatus of claim 6, wherein said resistive fibers are attached to said pyroelectric polymer with an adhesive.

8. The apparatus of claim 7, wherein said detoning member is grounded.

9. The apparatus of claim 8, wherein said pyroelectric polymer includes polyvinylidene fluoride.

10. The apparatus of claim 6, including a detoning member, said detoning member being positioned to be contacted by said resistive fibers.

11. The apparatus of claim 10, wherein said heater is an infrared heater.

12. An apparatus for removing charged toner particles from a charge retentive surface, said apparatus comprising:

a conductive belt;

at least one layer of a pyroelectric polymer covering said conductive belt;

flexible, resistive fibers extending from a surface of said pyroelectric polymer; and a heater in communication with said pyroelectric polymer for heating said pyroelectric polymer to produce surface potentials that bias said resistive fibers.

13. The apparatus of claim 12, wherein said resistive fibers are attached to said pyroelectric polymer with an adhesive.

14. The apparatus of claim 13, including a detoning member, said detoning member being positioned to be contacted by said resistive fibers.

15. The apparatus of claim 14, wherein said detoning member is grounded.

16. The apparatus of claim 15, wherein said heater is an infrared heater.

17. The apparatus of claim 12, wherein said pyroelectric polymer includes polyvinylidene fluoride.

* * * * *